US007819597B2

(12) United States Patent
Kohira

(10) Patent No.: US 7,819,597 B2
(45) Date of Patent: Oct. 26, 2010

(54) PRINTING METHOD AND PRINTER HAVING A PRINTING HEAD AND THERMAL ACTIVATION HEAD

(75) Inventor: Hiroyuki Kohira, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/387,244

(22) Filed: Apr. 30, 2009

(65) Prior Publication Data

US 2010/0104342 A1 Apr. 29, 2010

Related U.S. Application Data

(62) Division of application No. 11/226,740, filed on Sep. 14, 2005, now abandoned.

(51) Int. Cl.
*B41J 3/60* (2006.01)
*B41J 2/32* (2006.01)

(52) U.S. Cl. ..... 400/120.01; 400/188; 347/171; 347/197

(58) Field of Classification Search ..... 400/120.01, 400/120.18, 659, 149, 188; 347/212, 215, 347/218, 220, 221, 197; 271/902; *B41J 3/60*
See application file for complete search history.

(56) References Cited

U.S. PATENT DOCUMENTS 6,000,867 A * 12/1999 Yoshii et al. ..... 400/188
2006/0239740 A1 * 10/2006 Nam et al. ..... 400/120.01

FOREIGN PATENT DOCUMENTS

JP 2006051735 A * 2/2006

* cited by examiner

*Primary Examiner*—Leslie J Evanisko
(74) *Attorney, Agent, or Firm*—Adams & Wilks

(57) ABSTRACT

Provided is a printer capable of achieving its miniaturization and lightness. The printer includes: a roll accommodation unit (2) for retaining a heat-sensitive adhesive sheet (1) wound into a roll; a cutter unit (3) for cutting the heat-sensitive adhesive sheet (1); a printing/thermal activation unit having a printing thermal head (4) for performing printing on a printing surface of the heat-sensitive adhesive sheet (1) and a thermally-activating thermal head (5) for performing thermal activation on a heat-sensitive adhesive surface of the heat-sensitive adhesive sheet (1); and a stocking unit having a take-up device (6) for temporarily stocking the heat-sensitive adhesive sheet (1) by taking up the sheet on a take-up roller (6*a*).

2 Claims, 8 Drawing Sheets

PRINTING METHOD AND PRINTER HAVING A PRINTING HEAD AND THERMAL ACTIVATION HEAD

CROSS-REFERENCE TO RELATED APPLICATIONS

The present application is a divisional of U.S. application Ser. No. 11/226,740, filed Sep. 14, 2005, now abandoned.

BACKGROUND OF THE INVENTION

1. Field of the Invention

The present invention relates to a printer for performing recording on a sheet material and a printing method. In particular, the invention relates to a printer used for a sheet material having a recording surface (printing surface) on which recording such as printing is performed and a heat-sensitive adhesive surface that is formed on an opposite side of the recording surface and develops an adhesive force upon heating.

2. Description of the Related Art

Up to now, there is known an apparatus used as a printer for performing recording on a sheet material having a recording surface on one side and a heat-sensitive adhesive surface on the other side, as disclosed in JP 2003-316265 A (see FIG. 1).

The printer includes: a printing unit having a printing thermal head for performing printing on a recording surface of a sheet material; a cutter unit, arranged downstream of the printing unit, for cutting the sheet material to a predetermined length; and a thermal activation unit, arranged downstream of the cutter unit, having a thermally-activating thermal head for performing thermal activation on a heat-sensitive adhesive surface on the opposite side of the recording surface of the sheet material. Further, the printing unit and the thermal activation unit each include: a platen roller for conveying the sheet material while pressing it against a heat generating portion of the thermal head; a motor for rotating and driving the platen roller; and other components, as conveyance means for the sheet material.

In the printer as constructed above, while the sheet material is conveyed by the platen roller of the printing unit, the printing thermal head of the printing unit performs printing on the recording surface of the sheet material. After that, the cutting unit cuts the recorded sheet material to a predetermined length. Then, while one sheet of the recorded sheet material is conveyed by the platen roller of the thermal activation unit, the heat-sensitive adhesive surface on the opposite side of the recording surface of the sheet material is heated by the thermally-activating thermal head of the thermal activation unit. As a result, an adhesive force of the heat-sensitive adhesive surface develops, and the one sheet of the recorded sheet material can be directly affixed to a corrugated board, a food wrap, a glass bottle, a plastic container, etc.

Currently, miniaturization and lightness are increasingly demanded for a printer handling the above-mentioned sheet material in order that the printer is used as a mobile printer a person easily carries with one hand.

However, in the printer disclosed in JP 2003-316265 A, the printing unit and the thermal activation unit are separately constructed. Thus, a thermal head, a platen roller for conveying a sheet material, a motor, and the like must be provided in each of the printing unit and the thermal activation unit.

For this reason, the printer construction disclosed in JP 2003-316265 A has a limitation in achieving further lightness and miniaturization.

To solve the problem, there is a conventional thermal printer having a single thermal head arranged on a platen roller, and printing and thermal activation are selectively performed with the thermal head. In this printer, after printing is performed on a surface (printing surface) of a heat-sensitive adhesive sheet, the surface of the heat-sensitive adhesive sheet is reversed by a reversing roller. Then, the reversed heat-sensitive adhesive sheet is inserted again from a discharge side of the thermal head and thermal activation is performed on its rear surface (heat-sensitive adhesive surface).

However, the printer additionally needs the reversing roller, and there is a problem in that miniaturization of the apparatus is hindered.

In general, as shown in FIG. 9, a thermal printer adopts such a construction that a part of a heat generating portion 21*a* of a thermal head 21 is in press contact with an outer circumferential surface of a platen roller 22. Also, to miniaturize the head, in the thermal head 21, the heat generating portion 21*a* is arranged in the vicinity of one end portion 21*b* of the head. For this reason, regarding a distance between a thermal head substrate and the platen roller outer circumferential surface at portions other than the press contact part, the distance is extremely small on the end portion 21*b* side where the heat generating portion 21*a* is arranged than at an end portion 21*c* on the opposite side of the end portion 21*b*. Accordingly, it is difficult to insert a recording sheet from the end portion 21*b* side where the heat generating portion 21*a* is arranged.

Note that, to attain a construction allowing a sheet to be inserted from the end portion 21*b* side, a distance from the heat generating portion 21*a* to the end portion 21*b* may be set longer. However, if the distance is set longer in this way, the thermal head size becomes large, which leads to increase in costs.

SUMMARY OF THE INVENTION

The present invention has been made in view of the above-mentioned problems. It is therefore an object of the present invention to provide a printer capable of achieving reduced apparatus size and weight and reduced apparatus costs.

To achieve the above-mentioned object, according to an aspect of the present invention, a printer for performing printing on a sheet having: a printing surface on which printing is performed; and a heat-sensitive adhesive surface that is formed on an opposite side of the printing surface and develops an adhesive force upon heating, includes: a platen roller; and a printing/thermal activation unit having a printing head for performing printing on the printing surface and a thermal activation head for performing thermal activation on the heat-sensitive adhesive surface, the printing head and the thermal activation head being arranged on the platen roller. With this construction, instead of providing platen rollers to the printing unit and the thermal activation unit separately as in a conventional art, one platen roller is shared by the printing unit and the thermal activation unit, which leads to miniaturization and lightness of the apparatus.

Further, according to another aspect of the present invention, a printer for performing printing on a sheet having: a printing surface on which printing is performed; and a heat-sensitive adhesive surface that is formed on an opposite side of the printing surface and develops an adhesive force upon heating, includes: a platen roller; a printing/thermal activation unit having a printing/thermal activation head for performing printing on the printing surface and thermal activation on the heat-sensitive adhesive surface, the printing/thermal activation head being arranged on the platen roller;

and a stocking unit that is arranged downstream of the printing/thermal activation unit, temporarily stocks the sheet having the printing surface printed with the printing/thermal activation head, and conveys the temporarily stocked sheet toward the printing/thermal activation head.

In further aspect of the present invention, the printing/thermal activation unit has a conveyance path that is formed along an outer circumferential surface of the platen roller and through which the sheet is conveyed, and an exit of the conveyance path is connected to an insertion opening through which the sheet is inserted between the platen roller and the printing/thermal activation head during printing of the printing surface.

With this construction, during printing of the printing surface of the heat-sensitive adhesive sheet, the sheet is conveyed to the stocking unit while passing between the printing/thermal activation head and the platen roller and is then temporarily stocked. On the other hand, during thermal activation of the heat-sensitive adhesive surface that is the opposite surface of the sheet, the heat-sensitive adhesive sheet on which printing has been performed is delivered from the stocking unit to the printing/thermal activation unit. The delivered sheet is reversed through the conveyance path formed along an outer circumference of the platen roller and is inserted between the printing/thermal activation head and the platen roller from the same insert opening as that used during printing of the printing surface. In this way, printing and thermal activation are performed with the single thermal head.

According to the above construction, the printing unit and the thermal activation unit, which are separately provided conventionally, are integrated into one unit by arranging the printing head and the thermal activation head on one platen roller or by arranging the single printing/thermal activation head on one platen roller. Thus, miniaturization and lightness of the apparatus can be accomplished.

Also, according to the above construction, the printing unit and the thermal activation unit, which are separately provided conventionally, are integrated into one unit by arranging the single thermal head for performing printing and thermal activation on the platen roller. Thus, miniaturization and lightness of the apparatus can be achieved. In particular, the platen roller is used as a mechanism for reversing the heat-sensitive adhesive sheet during thermal activation on the heat-sensitive adhesive surface on the rear side of the heat-sensitive adhesive sheet whose printing surface on the front side has been printed. It is therefore unnecessary to additionally provide a reversing roller, thereby achieving reduction in the number of components as well as in costs for the apparatus.

Moreover, the heat-sensitive adhesive sheet is inserted between the head for performing printing and thermal activation and the platen roller from the same direction during both printing and thermal activation. Thus, it is possible to insert the sheet from the end portion side of the thermal head where the heat generating portion is not provided and thus a distance between the thermal head and the platen roller is wide. That is, during both printing and thermal activation, it is easy to insert the sheet between the thermal head and the platen roller while dispensing with a special mechanism.

DESCRIPTION OF THE PREFERRED EMBODIMENTS

Hereinafter, embodiments of the present invention will be described based on the accompanying drawings.

First Embodiment

Figure 1:
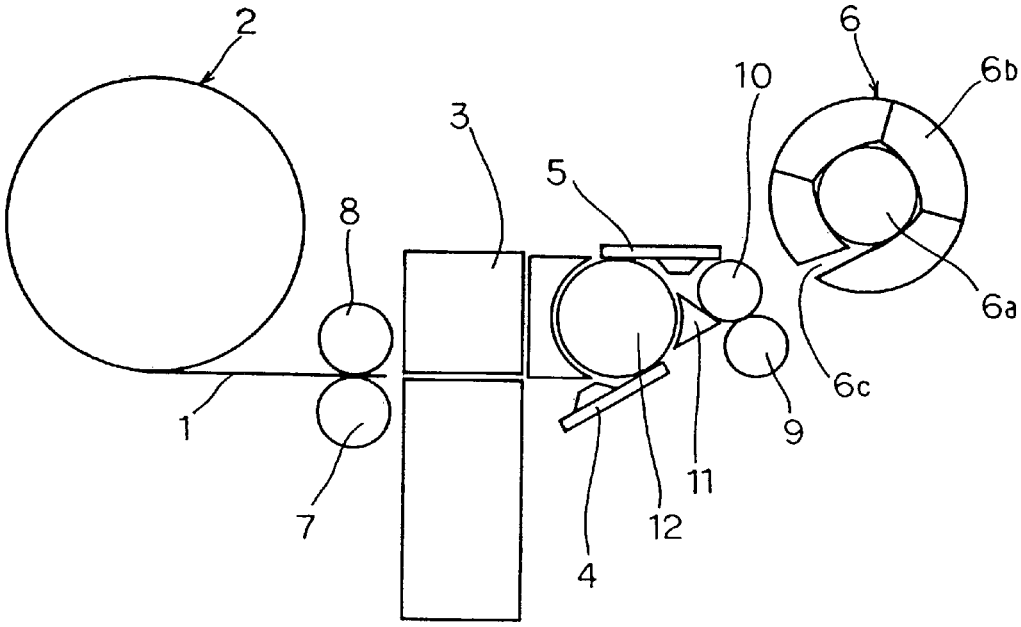
FIG. 1 is a schematic view showing a construction of a thermal printer according to a first embodiment of the present invention.
Figure 2:
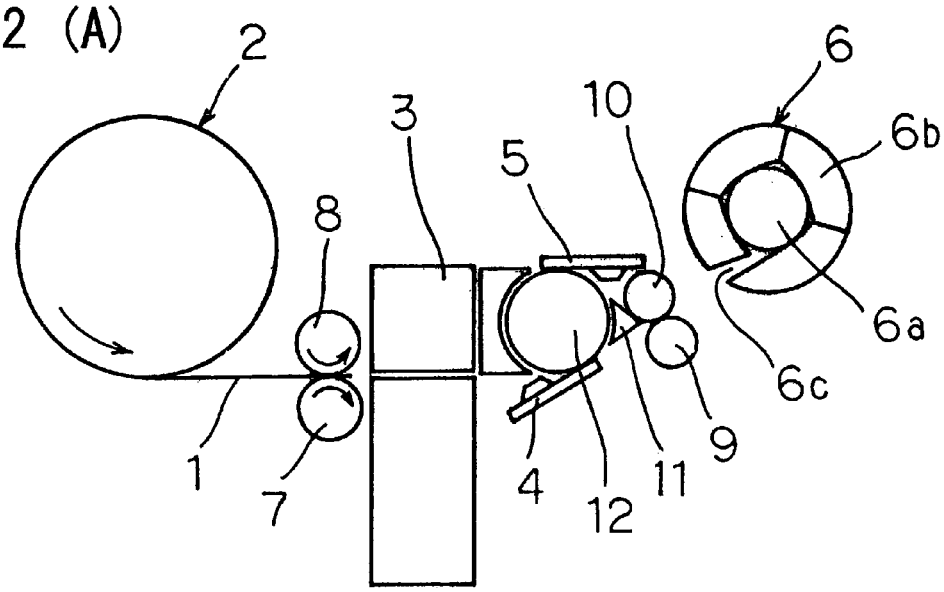
FIGS. 2A and 2B are each a schematic view for describing an operation of the thermal printer shown in FIG. 1.
Figure 2:
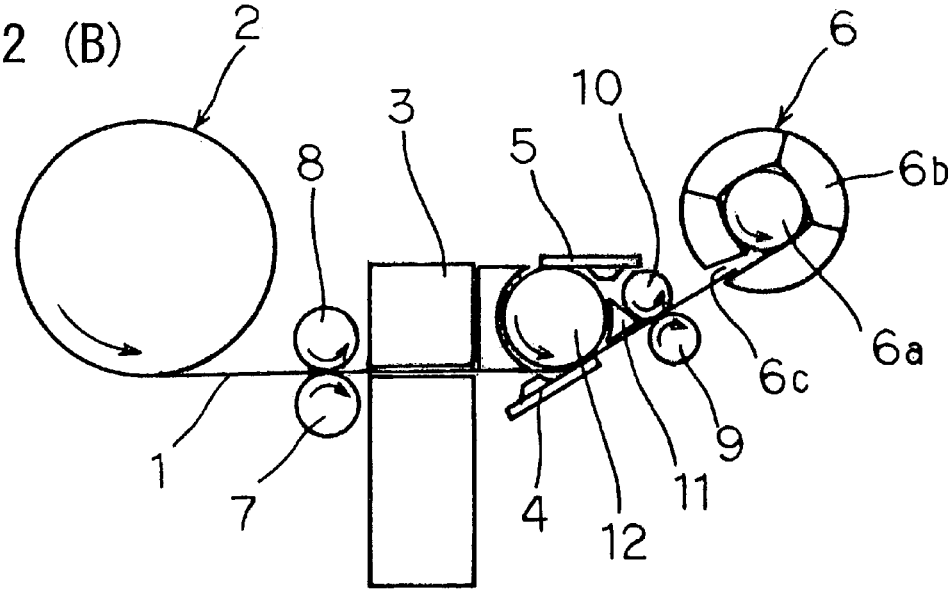
Figure 3:
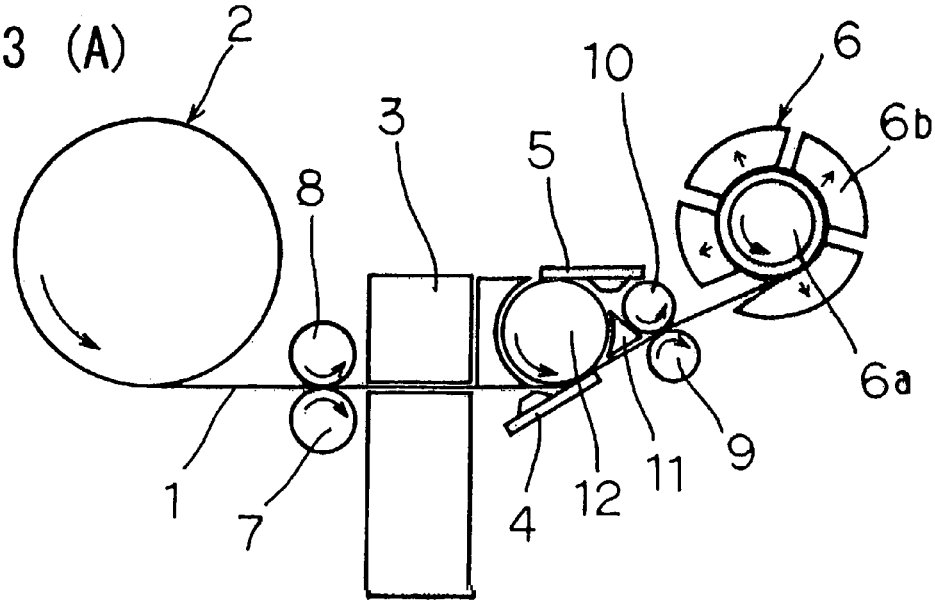
FIGS. 3A and 3B are each a schematic view for describing the operation of the thermal printer shown in FIG. 1.
Figure 3:
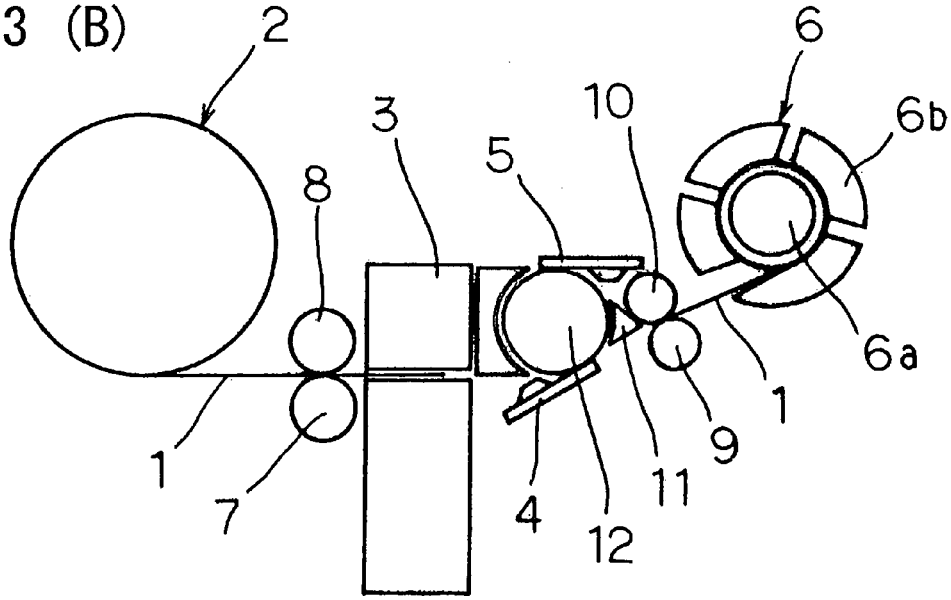

FIG. 1 is a schematic view showing a construction of a printer according to a first embodiment of the present invention.

The printer of the embodiment shown in FIG. 1 includes: a roll accommodation unit 2 for retaining a heat-sensitive adhesive sheet 1 wound into a roll; a cutter unit 3 for cutting the heat-sensitive adhesive sheet 1; a printing/thermal activation unit; and a stocking unit. The printing/thermal activation unit has a printing thermal head 4 for performing printing on a printing surface of the heat-sensitive adhesive sheet 1 and a thermally-activating thermal head 5 for performing thermal activation on a heat-sensitive adhesive surface of the heat-sensitive adhesive sheet 1. The stocking unit has a take-up device 6 for temporarily stocking the heat-sensitive adhesive sheet 1 by taking up the sheet on a take-up roller 6*a*. Note that, the term "printing" used herein includes formation of an image such as a picture or a pattern other than a character and a number.

The heat-sensitive adhesive sheet 1 has, for example, a heat insulation layer and a heat sensitive color development layer (printable layer) formed on a front surface of a sheet material, and a heat-sensitive adhesive layer formed on a rear surface and prepared by applying a heat-sensitive adhesive and drying it. The heat-sensitive adhesive layer is made of a heat-sensitive adhesive containing a thermosetting resin, a solid plastic resin, or the like as a main component. The heat-sensitive adhesive sheet 1 may not have the heat insulation layer or may have a protective layer or a colored printing layer (a layer on which printing has been performed in advance) on the surface of the heat-sensitive color development layer.

The printing thermal head 4 has plural heat generating elements structured by a plurality of relatively small resistors arranged in a width direction for performing dot printing. In this embodiment, the thermally-activating thermal head 5 has the same construction as the printing thermal head 4, that is, the same construction as a printing head of a known thermal printer. The known printer head is structured by forming plural heat generating resistors on a ceramic substrate through a thin film technology and forming a protective film made of crystalline glass on surfaces of the heat generating resistors. In this way, the same construction as that of the printing thermal head 4 is employed for the thermally-activating thermal head 5, thus sharing the components and achieving reduction in costs. Note that, the heat generating elements of the thermally-activating thermal head 5 do not need to be segmented in units of a dot like the heat generating elements of the printing thermal head 4, and may be continuous resistors.

Arranged downstream of the roll accommodation unit 2 are a conveying roller 7 functioning as conveyance means for conveying the heat-sensitive adhesive sheet 1 by drawing out the sheet from the roll accommodation unit 2, and a driven roller 8 that is driven and rotates while pressed against the conveying roller 7. The conveying roller 7 has a driving system (not shown) composed of a stepping motor, a gear train, and the like. The heat-sensitive adhesive sheet 1 fitted on the roll accommodation unit 2 is drawn out from the roll and delivered to the right side of the drawing by rotating the conveying roller 7 clockwise with the driving system.

Arranged downstream of the conveying roller 7 is the cutter unit 3 for cutting the heat-sensitive adhesive sheet 1 on which printing has been performed by the printing thermal head 4 to a desired length. The cutter unit 3 has a movable blade (not shown) operated by a drive source such as an electric motor (not shown), a stationary blade (not shown) opposing the movable blade, etc.

The printing/thermal activation unit is arranged downstream of the cutter unit 3. In the printing/thermal activation unit, the printing thermal head 4 and the thermally-activating thermal head 5 are both arranged on an outer circumferential surface of one platen roller 12. At this time, an insertion opening through which the heat-sensitive adhesive sheet 1 is inserted between the printing thermal head 4 and the platen roller 12 and an insertion opening through which the heat-sensitive adhesive sheet 1 is inserted between the thermally-activating thermal head 5 and the platen roller 12 face in opposite directions. In other words, the printing thermal head 4 and the thermally-activating thermal head 5 are situated substantially on opposite sides of the platen roller 12, and face in the same direction with reference to an outer circumference of the platen roller 12.

The printing thermal head 4 and the thermally-activating thermal head 5 are in press contact with the platen roller 12 due to a spring force of pressurizing means such as a coil spring or a leaf spring (not shown). In particular, the respective heat generating element portions of the printing thermal head 4 and the thermally-activating thermal head 5 are in close contact with the outer circumferential surface of the platen roller 12. Since the heat generating elements are arranged in an end portion of each of the thermal heads 4 and 5, the insertion opening is formed between the platen roller 12 and an end portion opposite to the end portion where the heat generating elements are arranged.

Further, the printing/thermal activation unit has a driving system (not shown) composed of a stepping motor, a gear train, and the like for rotating and driving the platen roller 12. By rotating the platen roller 12 counterclockwise with the driving system, the heat-sensitive adhesive sheet 1 drawn out from the roll accommodation unit 2 is delivered to the stocking unit in downstream while performing printing on the sheet with the printing thermal head 4, or the heat-sensitive adhesive sheet 1 drawn out from the stocking unit is delivered toward an outside of the apparatus while performing thermal activation on the sheet with the thermally-activating thermal head 5.

The stocking unit is arranged downstream of the printing/thermal activation unit. The take-up device 6 of the stocking unit has the take-up roller 6*a* for taking up the printed heat-sensitive adhesive sheet 1 being conveyed, and plural guides 6*b* so arranged as to surround an outer circumferential surface of the take-up roller 6*a*. The take-up roller 6*a* is controlled by using rotation drive means such as a motor. A frictional resistance between the outer circumferential surface of the take-up roller 6*a* and the heat-sensitive adhesive sheet 1 is set larger than a frictional resistance between the heat-sensitive adhesive sheet 1 and the guides 6*b*.

The guides 6*b* are attached to the outer circumferential surface of the take-up roller 6*a* while urged by an elastic member. Thus, the guides 6*b* are in close contact with the outer circumferential surface of the take-up roller 6*a*. When a pile thickness of the heat-sensitive adhesive sheet 1 on the take-up roller 6*a* increases as the heat-sensitive adhesive sheet 1 is taken up on the take-up roller 6*a*, the guides 6*b* are moved toward an outside in a radius direction, of the take-up roller 6*a* by an amount corresponding to the thickness, thereby widening a distance between the outer circumferential surface of the take-up roller 6*a* and the guides 6*b*. To achieve such a function, for example, by hanging a rubber band or a spring on an outer circumferential surface formed by all the guides 6*b* around the take-up roller 6*a*, the guides 6*b* are attached to the outer circumferential surface of the take-up roller 6*a* while urged by the rubber band or the spring.

The take-up device 6 has an insertion opening 6*c* through which the heat-sensitive adhesive sheet 1 is inserted between the outer circumferential surface of the take-up roller 6*a* and the guides 6*b*. Arranged immediately before the insertion opening 6*c* are a conveying roller 9 for conveying the heat-sensitive adhesive sheet 1 and a driven roller 10 that is driven and rotates while pressed against the conveying roller 9. The conveying roller 9 and the driven roller 10 introduce the heat-sensitive adhesive sheet 1 conveyed while passing through the printing/thermal activation unit into the insertion opening 6*c* of the take-up device 6, or extract the heat-sensitive adhesive sheet 1 taken up by the take-up device 6 out of the insertion opening 6*c* toward the printing/thermal activation unit. The switching between introduction and extraction of the heat-sensitive adhesive sheet 1 is effected by changing a rotational direction of the conveying roller 9. Note that, the conveying roller 9 is in synchronization with a rotational operation of the take-up roller 6*a*.

Conveying direction regulating means 11 for regulating the conveying direction of the heat-sensitive adhesive sheet 1 is arranged between the conveying roller 9 and the platen roller 12. At the time of printing, the conveying direction regulating means 11 regulates the sheet conveying direction so that the heat-sensitive adhesive sheet 1, which has been undergone printing by the printing thermal head 4 while passing between the printing thermal head 4 of the printing/thermal activation unit and the platen roller 12, is delivered into the take-up device 6. Then, at the time of thermal activation, the conveying direction regulating means 11 regulates the sheet conveying direction so that the heat-sensitive adhesive sheet 1 is delivered to a position between the thermally-activating thermal head 5 of the printing/thermal activation unit and the platen roller 12 from the take-up device 6. With this construction, when the heat-sensitive adhesive sheet 1 temporarily stocked in the take-up device 6 is delivered to the position between the thermally-activating thermal head 5 of the printing/thermal activation unit and the platen roller 12 upon thermal activation, the sheet is prevented from being delivered to a position between the printing thermal head 4 and the platen roller 12.

Next, based on FIGS. 2A to 4, an operation of the thermal printer according to this embodiment will be described. FIGS. 2A to 4 are each a schematic view showing the operation of the printer shown in FIG. 1.

First, the heat-sensitive adhesive sheet 1 wound into a roll is fitted onto the roll accommodation unit 2. As shown in FIG. 2A, the sheet is drawn out from the roll accommodation unit 2 while nipped by the conveying roller 7 and the driven roller 8.

After that, as shown in FIG. 2B, when the heat-sensitive adhesive sheet 1 is conveyed while passing the cutter unit 3, the platen roller 12 rotates counterclockwise, and printing control of the printing thermal head 4 starts. The heat-sensitive adhesive sheet 1 is nipped between the platen roller 12 and the printing thermal head 4 and conveyed by means of rotation drive of the platen roller 12, whereby printing is performed on the printable layer (heat-sensitive color development layer) by the printing thermal head 4.

A leading end of the heat-sensitive adhesive sheet 1 having passed the printing thermal head 4 of the printing/thermal activation unit is directed to the stocking unit side by the conveying direction regulating means 11 and nipped between the conveying roller 9 and the driven roller 10.

Then, with rotation drive of the conveying roller 9 and the driven roller 10, the heat-sensitive adhesive sheet 1 is conveyed and inserted into the insertion opening 6*c* of the take-up device 6. At this time, the take-up roller 6*a* rotates at the same rotation rate as that of the conveying roller 9.

As shown in FIG. 3A, the heat-sensitive adhesive sheet 1 inserted into the insertion opening 6*c* is taken up on the take-up roller 6*a* of the take-up device 6 as it advances. At this time, the guides 6*b* press the heat-sensitive adhesive sheet 1 against the outer circumferential surface of the take-up roller 6*a* with an urging force of the elastic member, and therefore the heat-sensitive adhesive sheet 1 is reliably taken up on the take-up roller 6*a*. When a pile thickness of the heat-sensitive adhesive sheet 1 on the take-up roller 6*a* increases as the take-up roller 6*a* takes up the heat-sensitive adhesive sheet 1 thereon, the guides 6*b* are moved toward the outside in the radius direction of the take-up roller 6*a* by an amount corresponding to the thickness, thereby widening a distance between the outer circumferential surface of the take-up roller 6*a* and the guides 6*b*.

When the printing operation by the printing thermal head 4 is completed, rotating operations of the take-up roller 6*a*, the conveying roller 7, the conveying roller 9, and the platen roller 12 stop, and the heat-sensitive adhesive sheet 1 is cut at a desired position by the cutter unit 3.

After the cutting, the conveying roller 7 remains at rest, and the rotating operations of the take-up roller 6*a*, the conveying roller 9, and the platen roller 12 start again. The take-up roller 6*a*, the conveying roller 9, and the platen roller 12 are kept driving until the trailing end of the cut heat-sensitive adhesive sheet 1 reaches a position between the conveying roller 9 and the driven roller 10 as shown in FIG. 3B. At this time, the leading end of the cut heat-sensitive adhesive sheet 1 is further taken up on the take-up roller 6*a*.

Figure 4:
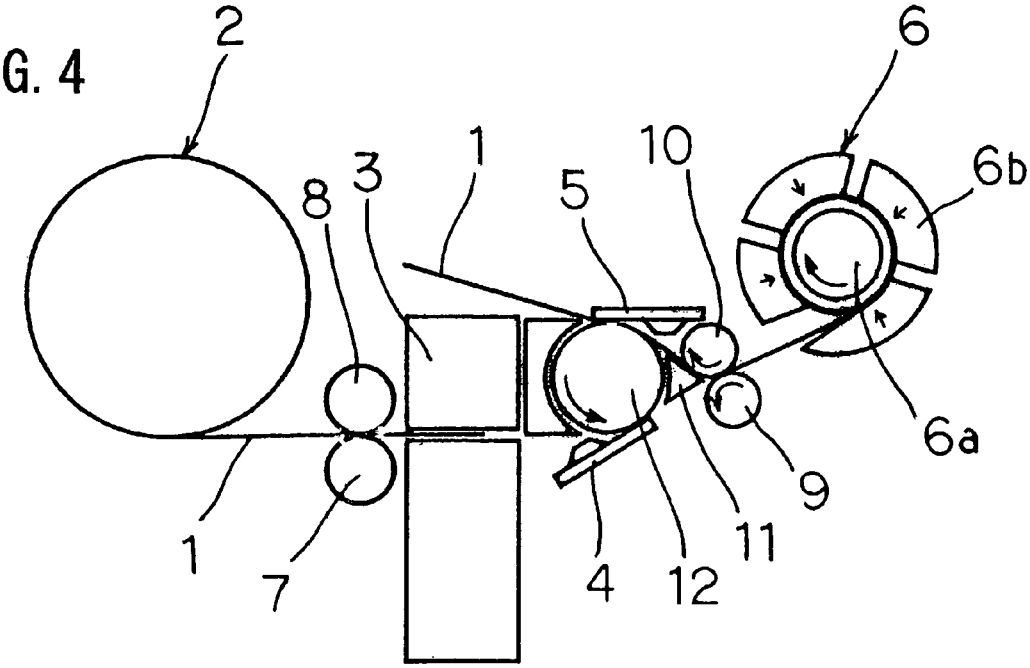
FIG. 4 is a schematic view for describing the operation of the thermal printer shown in FIG. 1.

After that, as shown in FIG. 4, rotation directions of the take-up roller 6*a* and the conveying roller 9 are reversed. Thus, the heat-sensitive adhesive sheet 1 temporarily stocked while taken up in the take-up device 6 is drawn out from the take-up device 6 through the insertion opening 6*c*. At this time, the conveying direction of the heat-sensitive adhesive sheet 1 temporarily stocked is directed toward a position between the thermally-activating thermal head 5 and the platen roller 12.

When the heat-sensitive adhesive sheet 1 is conveyed to the printing/thermal activation unit again, the platen roller 12 rotates counterclockwise and heating control of the thermally-activating thermal head 5 starts. The printing control of the printing thermal head 4 remains interrupted at this time.

The heat-sensitive adhesive sheet 1 delivered from the take-up device 6 is nipped between the platen roller 12 and the thermally-activating thermal head 5 and conveyed through rotation drive of the take-up roller 6*a*, the conveying roller 9, and the platen roller 12, whereby the heat-sensitive adhesive layer is heated by the thermally-activating thermal head 5. When this heating process is completed, the entire heat-sensitive adhesive sheet 1 temporarily stocked in the take-up device 6 has been drawn out. Accordingly, the guides 6*b* of the take-up device 6 are restored to a state in which they are held in contact with the outer circumferential surface of the take-up roller 6*a* by the elastic member as shown in FIG. 2B.

The heat-sensitive adhesive sheet 1 of a predetermined length which has thus undergone printing, cutting, and heating is discharged outside the apparatus as described above and directly affixed to a corrugated board, a food wrap, a glass bottle, a plastic container, etc. as an indicator label.

As discussed previously, in the thermal printer of this embodiment, the printing unit and the thermal activation unit, which are separately provided conventionally, are integrated into one unit by arranging the printing thermal head 4 and the thermally-activating thermal head 5 in a single platen roller. Thus, miniaturization and lightness of the apparatus can be achieved.

Note that, although a printing head of a heat sensitive system such as a thermal printer is adopted as the printing head in the above embodiment, the present invention is also applicable to a printing head of a heat transfer system, an ink jet system, a laser print system, or the like. In such a case, a sheet material subjected to a processing suited to each printing system is used for the printable layer of the sheet material in place of the heat-sensitive printing layer.

Further, the printer of the above embodiment can be configured as a double-sided printer by replacing the thermally-activating thermal head 5 with a printing head. In this case, plain paper is used instead of the heat-sensitive adhesive sheet.

Second Embodiment

Figure 5:
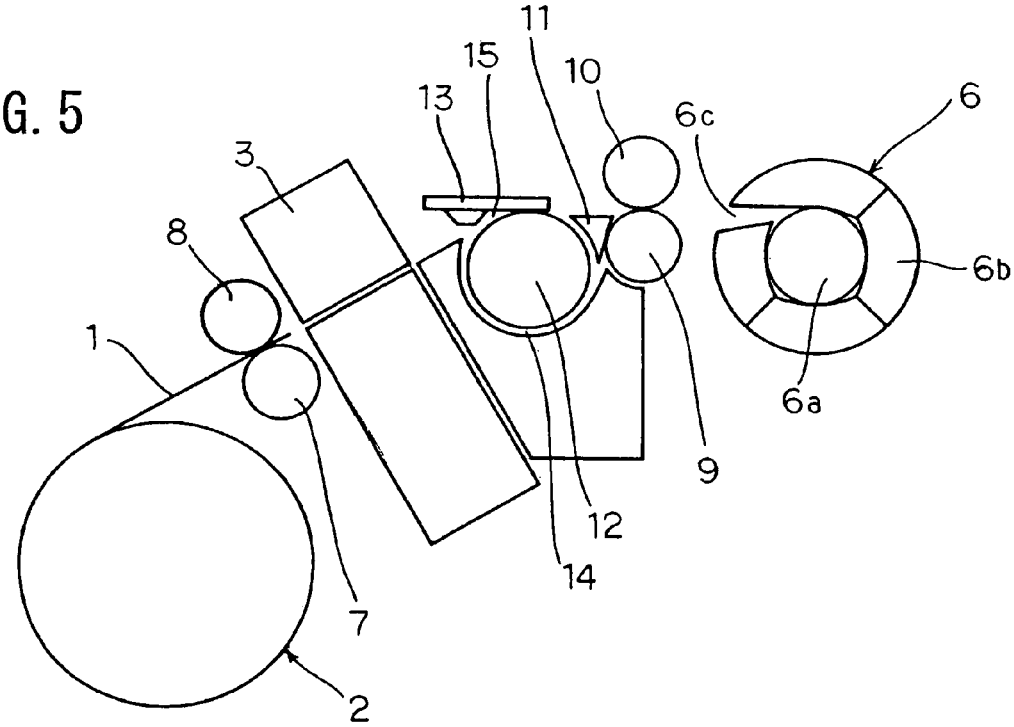
FIG. 5 is a schematic view showing a construction of a thermal printer according to a second embodiment of the present invention.
Figure 6:
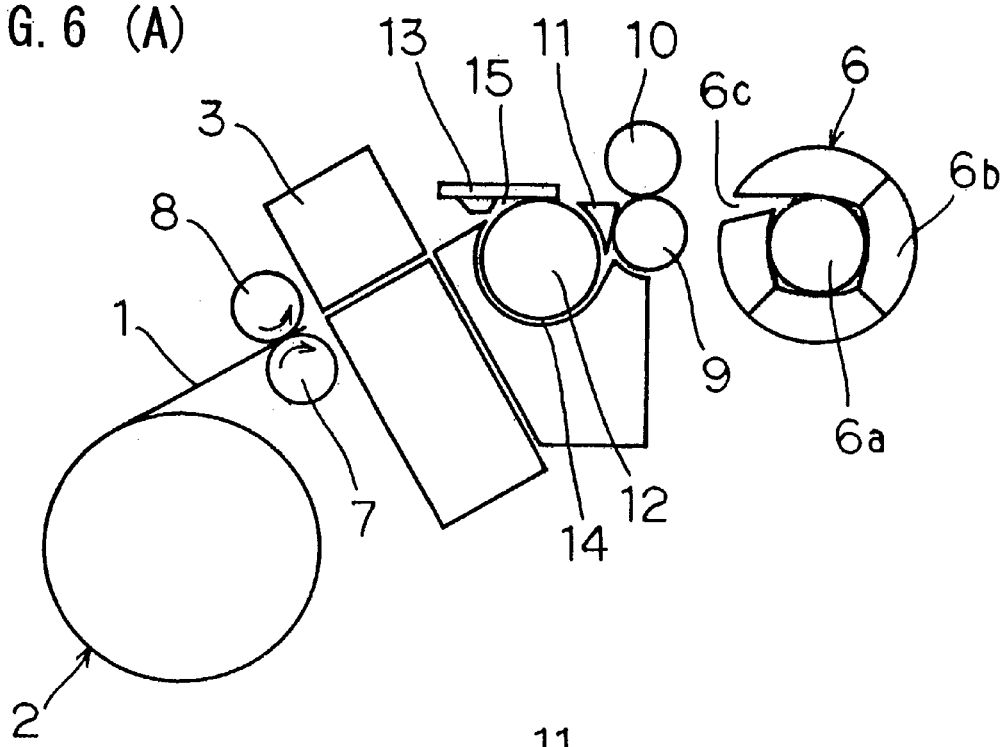
FIGS. 6A and 6B are each a schematic view for describing an operation of the thermal printer shown in FIG. 5.
Figure 6:
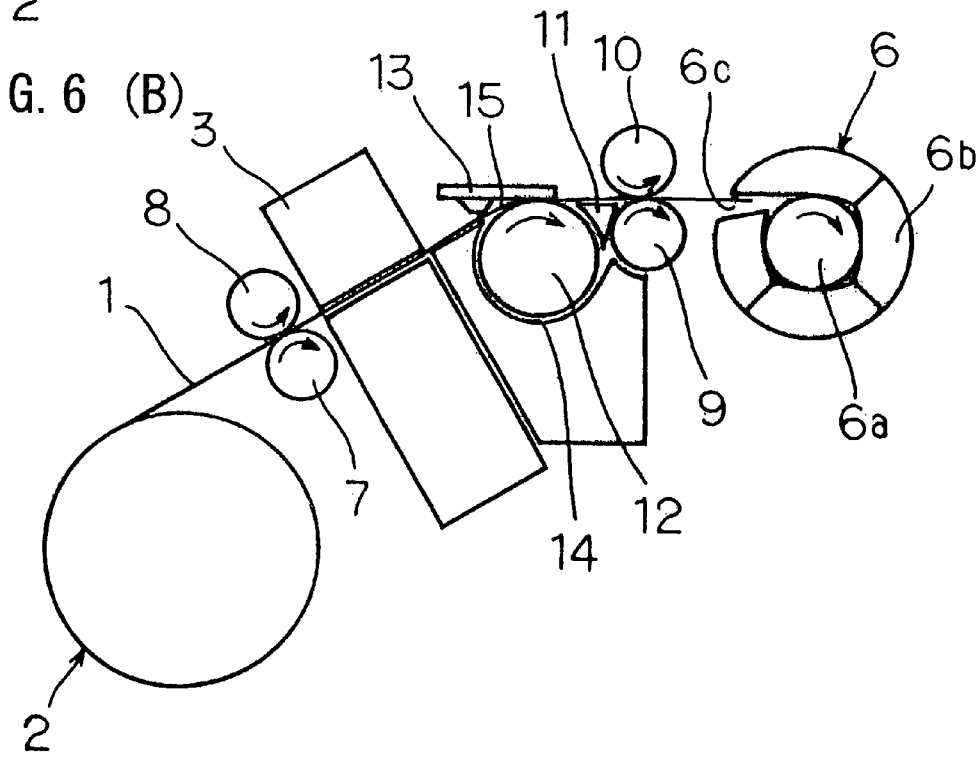
Figure 7:
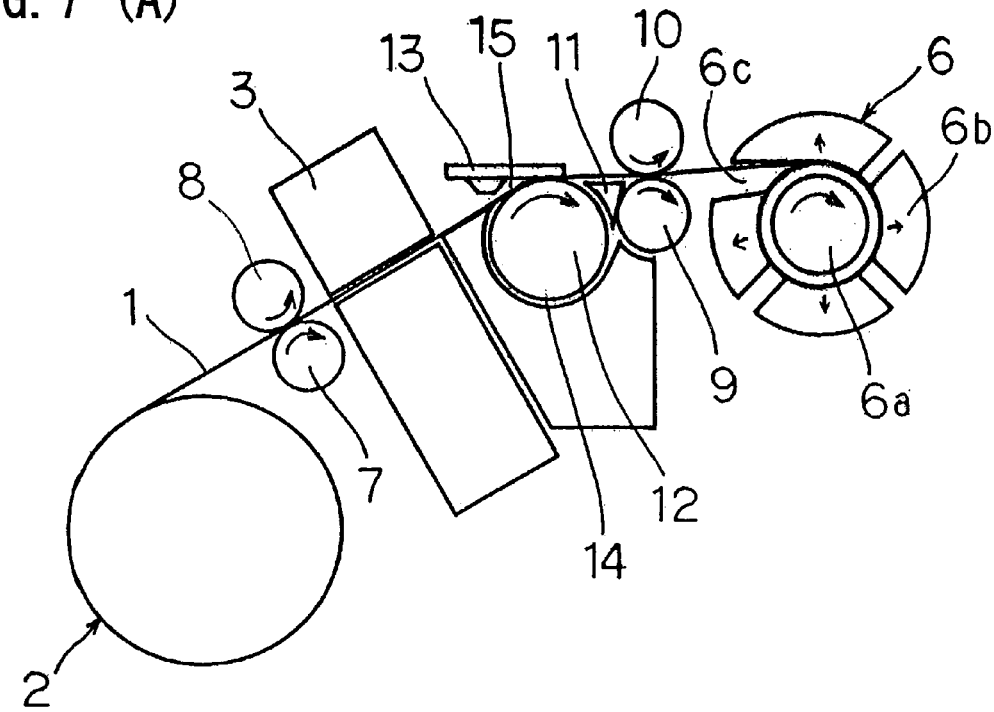
FIGS. 7A and 7B are each a schematic view for describing the operation of the thermal printer shown in FIG. 5.
Figure 7:
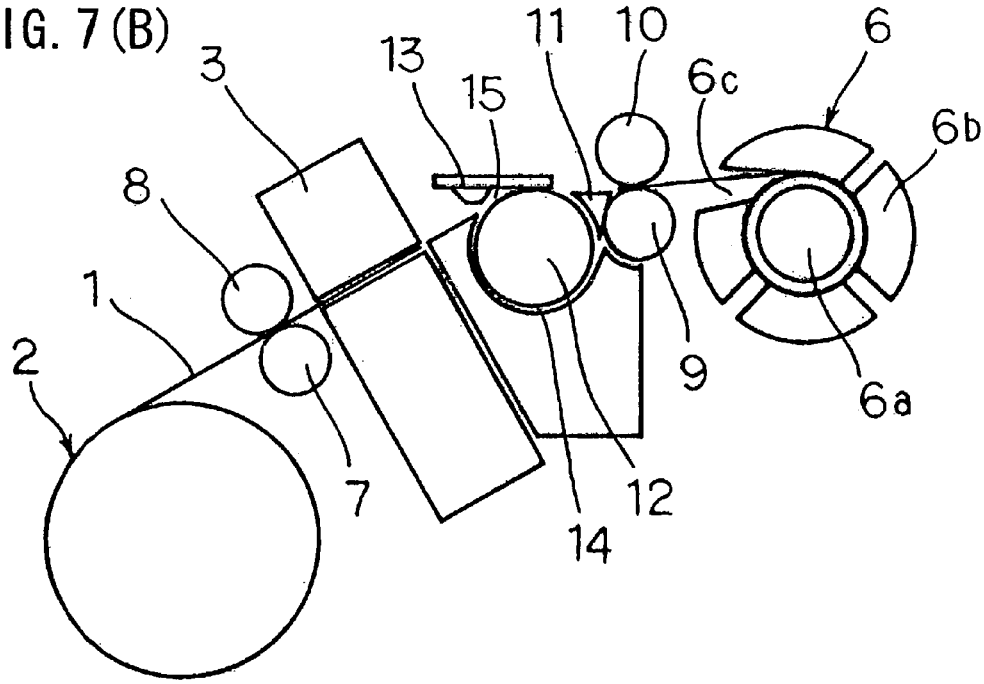
Figure 8:
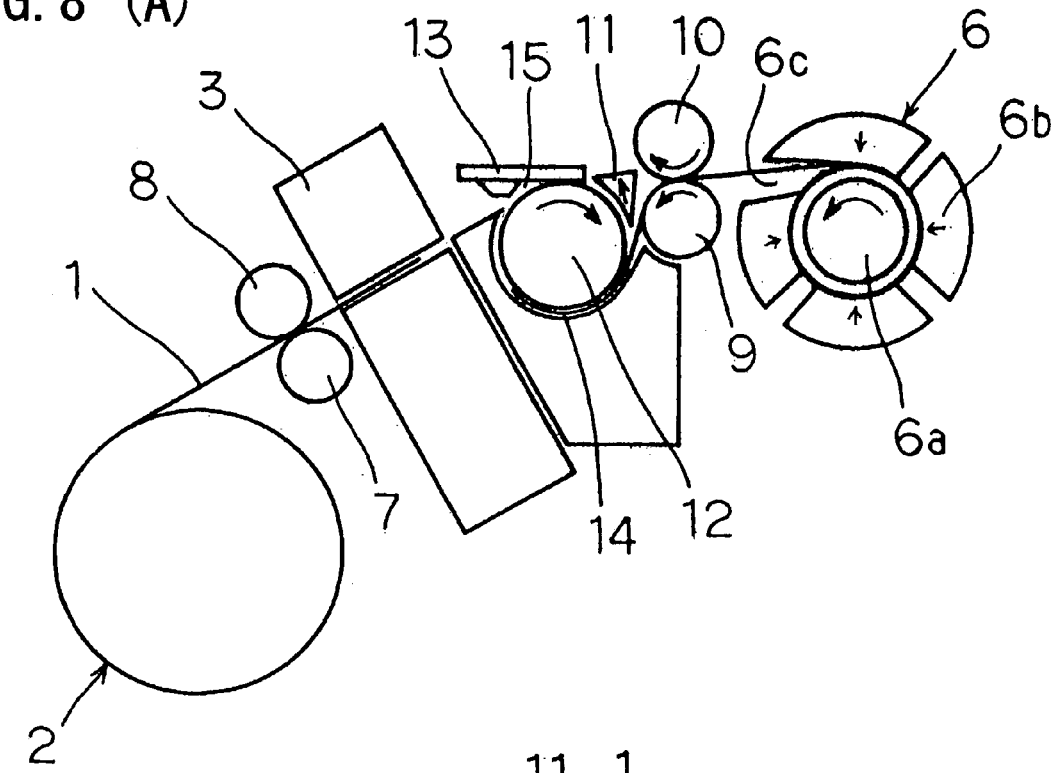
FIGS. 8A and 8B are each a schematic view for describing the operation of the thermal printer shown in FIG. 5.
Figure 8:
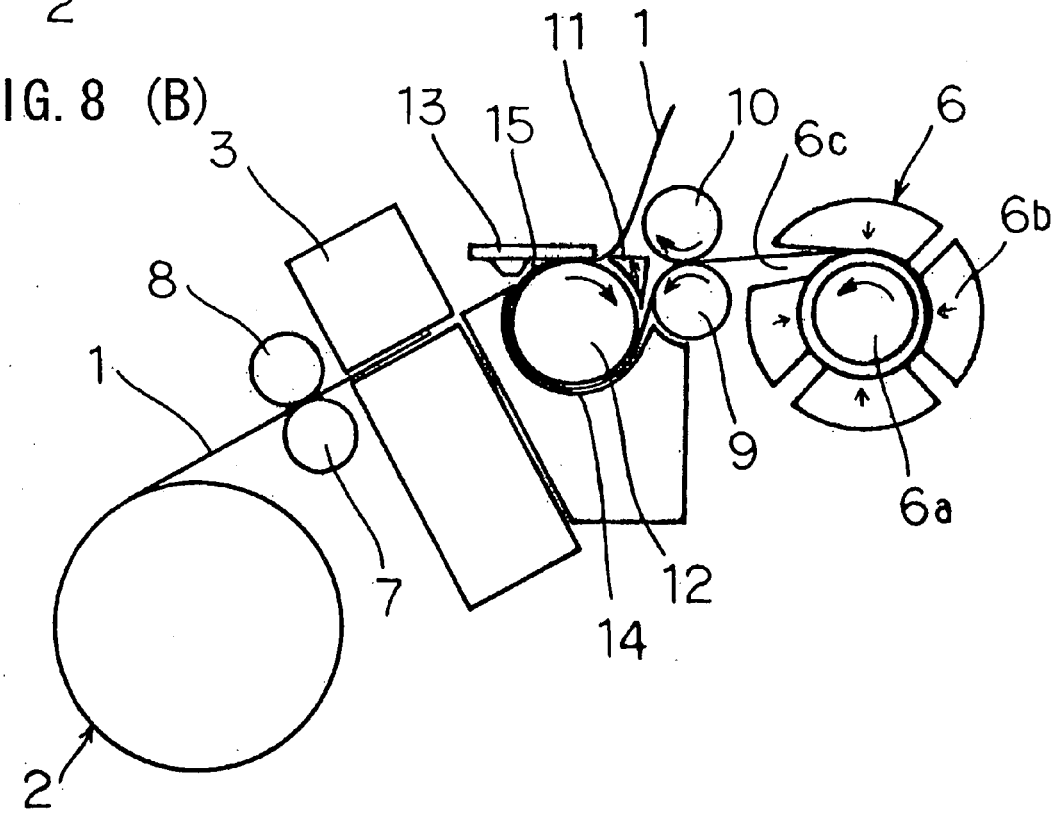
Figure 9:
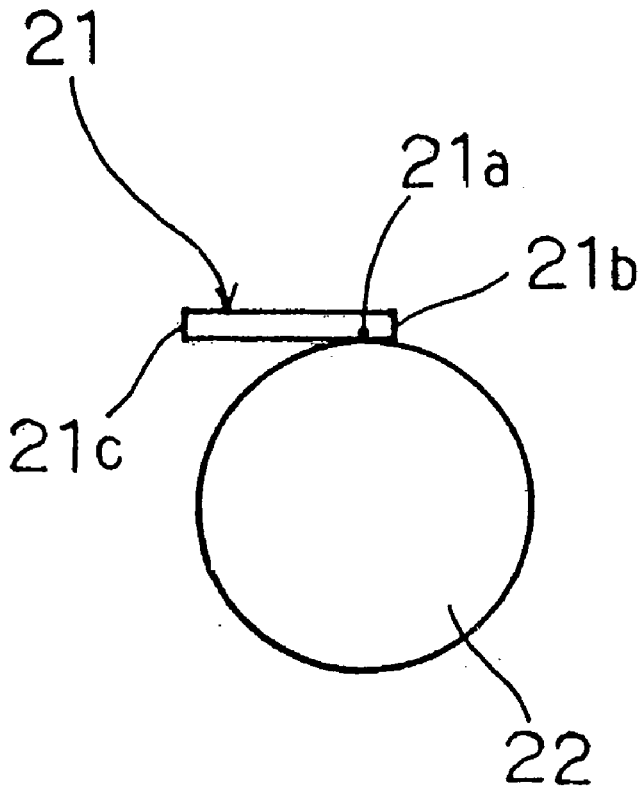
FIG. 9 PRIOR ART
FIG. 9 is a view showing a positional relationship between a heat generating portion and a platen roller of a general thermal head.

FIG. 5 is a schematic view showing a construction of a thermal printer according to a second embodiment of the present invention.

In the above-mentioned first embodiment, to integrate the printing unit and the thermal activation unit, which are separately provided conventionally, into one unit, the printing thermal head 4 and the thermally-activating thermal head 5 are arranged in a single platen roller. The second embodiment provides a construction where a single platen roller is provided with a single printing/thermal activation head.

Hereinafter, the printer of the second embodiment will be described. For describing the printer of this embodiment, the same components as those constituting the printer of the first embodiment are denoted by the same reference numerals and a description thereof is omitted.

As shown in FIG. 5, the printer of this embodiment includes: a roll accommodation unit 2 for retaining a heat-sensitive adhesive sheet 1 wound into a roll; a cutter unit 3 for cutting the heat-sensitive adhesive sheet 1; a printing/thermal activation unit; a stocking unit; and an applied energy control portion (not shown) for controlling an energy applied to a printing/thermal activation head 13. The printing/thermal activation unit has a printing/thermal activation head 13 for performing printing on a printing surface of the heat-sensitive adhesive sheet 1 or thermal activation on a heat-sensitive adhesive surface of the heat-sensitive adhesive sheet 1. The stocking unit has a take-up device 6 for temporarily stocking the heat-sensitive adhesive sheet 1 by taking up the sheet on a take-up roller 6*a*. The applied energy control portion of the present invention is similar to energy control means used in a known thermal printer, but can selectively give an energy condition for energy to be applied to the thermal head during printing and an energy condition for energy to be applied to the thermal head during thermal activation to a single thermal head as appropriate. Thus, printing and thermal activation can be effectively performed with the single thermal head.

The printing/thermal activation head 13 has plural heat generating elements structured by a plurality of relatively small resistors arranged in a width direction for performing dot printing. The heat generating elements have the same construction as that of a printing head of a known thermal printer, which is structured by forming plural heat generating resistors on a ceramic substrate through a thin film technology and forming a protective film made of crystalline glass on surfaces of the heat generating resistors.

The printing/thermal activation unit is arranged between the cutter unit 3 and the stocking unit having the take-up device 6. In the printing/thermal activation unit, the printing/thermal activation head 13 is arranged on an outer circumferential surface of one platen roller 12. The printing/thermal activation head 13 is in press contact with the platen roller 12 due to a spring force of pressurizing means such as a coil spring or a leaf spring (not shown). In particular, the portion of the printing/thermal activation head 13 where the heat generating elements are arranged is in close contact with the outer circumferential surface of the platen roller 12. Since the heat generating elements are arranged in an end portion of the printing/thermal activation head 13, an insertion opening 15, through which the heat-sensitive adhesive sheet 1 is inserted between the printing/thermal activation head 13 and the platen roller 12, is formed between the platen roller 12 and an end portion of the thermal head 13 opposite to the end portion where the generating elements are arranged.

Further, a conveyance path 14 through which the heat-sensitive adhesive sheet 1 is reversed is formed along approximately the half of the outer circumferential surface of the platen roller 12. The entrance of the conveyance path 14 is situated on the stocking unit side. The exit of the conveyance path 14 is continuous to the insertion opening 15 through which the heat-sensitive adhesive sheet 1 is inserted between the printing/thermal activation head 13 and the platen roller 12 during printing. With this construction, the conveying direction for inserting the heat-sensitive adhesive sheet 1 between the printing/thermal activation head 13 and the platen roller 12 during printing is the same as that during thermal activation.

The printing/thermal activation unit has a driving system (not shown) composed of a stepping motor, a gear train, and the like, for rotating and driving the platen roller 12. By rotating the platen roller 12 clockwise with the driving system, the heat-sensitive adhesive sheet 1 taken from the roll accommodation unit 2 is delivered to the stocking unit in downstream while undergoing printing by the printing/thermal activation head 13, or the heat-sensitive adhesive sheet 1 taken from the stocking unit is reversed in the conveyance path 14 and then delivered outside the apparatus while thermally activated by the printing/thermal activation head 13.

In addition, conveying direction regulating means 11 for regulating the conveying direction of the heat-sensitive adhesive sheet 1 is arranged between the conveying roller 9 and the platen roller 12. At the time of printing, the conveying direction regulating means 11 regulates the sheet conveying direction so that the heat-sensitive adhesive sheet 1 that has undergone printing with the printing/thermal activation head 13 while passing between the printing/thermal activation head 13 and the platen roller 12 is delivered into the take-up device 6. Then, at the time of thermal activation, the conveying direction regulating means 11 regulates the sheet conveying direction so that the heat-sensitive adhesive sheet 1 is delivered to a position between the printing/thermal activation head 13 and the platen roller 12 from the take-up device 6 via the conveyance path 14 on the outer circumferential surface of the platen roller 12. With this construction, when the heat-sensitive adhesive sheet 1 temporarily stocked in the stocking unit is to be delivered to the position between the printing/thermal activation head 13 and the platen roller 12 during thermal activation, the sheet conveying direction is regulated such that the sheet is conveyed from the take-up device 6 of the stocking unit only in a direction toward the conveyance path 14.

Next, based on FIGS. 6A to 8B, an operation of the thermal printer according to this embodiment will be described. FIGS. 6A to 8B are each a schematic view showing the operation of the printer shown in FIG. 5.

First, the heat-sensitive adhesive sheet 1 wound into a roll is fitted onto the roll accommodation unit 2. As shown in FIG. 6A, the sheet is drawn out from the roll accommodation unit 2 while nipped by a conveying roller 7 and a driven roller 8.

After that, as shown in FIG. 6B, when the heat-sensitive adhesive sheet 1 is conveyed while passing the cutter unit 3, the platen roller 12 rotates counterclockwise, and printing control of the printing/thermal activation head 13 starts. The heat-sensitive adhesive sheet 1 is nipped between the platen roller 12 and the printing/thermal activation head 13 and conveyed by means of rotation drive of the platen roller 12, whereby printing is performed on the printable layer (heat-sensitive color development layer) by the printing/thermal activation head 13.

A leading end of the heat-sensitive adhesive sheet 1 having passed the printing/thermal activation unit is directed to the stocking unit side by the conveying direction regulating means 11 and nipped between the conveying roller 9 and the driven roller 10.

Then, with rotation drive of the conveying roller 9 and the driven roller 10, the heat-sensitive adhesive sheet 1 is conveyed and inserted into an insertion opening 6*c* of the take-up device 6. At this time, the take-up roller 6*a* rotates at the same rotation rate as that of the conveying roller 9.

As shown in FIG. 7A, the heat-sensitive adhesive sheet 1 inserted into the insertion opening 6*c* is taken up on the take-up roller 6*a* of the take-up device 6 as it advances. At this time, the guides 6*b* press the heat-sensitive adhesive sheet 1 against the outer circumferential surface of the take-up roller 6*a* with an urging force of an elastic member, and therefore the heat-sensitive adhesive sheet 1 is reliably taken up on the take-up roller 6*a*. When a pile thickness of the heat-sensitive adhesive sheet 1 on the take-up roller 6*a* increases as the take-up roller 6*a* takes up the heat-sensitive adhesive sheet 1 thereon, the guides 6*b* are moved toward an outside in a radius direction of the take-up roller 6*a* by an amount corresponding to the thickness, thereby widening a distance between the outer circumferential surface of the take-up roller 6*a* and the guides 6*b*.

When the printing operation by the printing thermal head 4 is completed, rotating operations of the take-up roller 6*a*, the conveying roller 7, the conveying roller 9, and the platen roller 12 stop, and the heat-sensitive adhesive sheet 1 is cut at a desired position by the cutter unit 3.

After the cutting, the conveying roller 7 remains at rest, and the rotating operations of the take-up roller 6*a*, the conveying roller 9, and the platen roller 12 start again. The take-up roller 6*a*, the conveying roller 9, and the platen roller 12 are kept driving until a trailing end of the cut heat-sensitive adhesive sheet 1 reaches a position between the conveying roller 9 and the driven roller 10 as shown in FIG. 7B. At this time, the leading end of the cut heat-sensitive adhesive sheet 1 is further taken up on the take-up roller 6*a*.

Then, as shown in FIG. 8A, rotation directions of the take-up roller 6*a* and the conveying roller 9 are reversed. Thus, the heat-sensitive adhesive sheet 1 temporarily stocked while taken up in the take-up device 6 is drawn out from the take-up device 6 through the insertion opening 6*c*. At this time, the conveying direction of the heat-sensitive adhesive sheet 1 temporarily stocked is switched to the conveyance path 14 entrance side as the conveying direction regulating means 11 rises.

When the heat-sensitive adhesive sheet 1 is conveyed to the printing/thermal activation unit again, the platen roller 12 rotates clockwise and heating control of the printing/thermal activation head 13 starts.

As shown in FIG. 8B, the heat-sensitive adhesive sheet 1 delivered from the take-up device 6 passes through the conveyance path 14 and is nipped between the platen roller 12 and the printing/thermal activation head 13. Then, the sheet is conveyed by means of rotation drive of the take-up roller 6*a*, the conveying roller 9, and the platen roller 12, whereby the heat-sensitive adhesive layer is heated by the printing/thermal activation head 13. When this heating process is completed, the entire heat-sensitive adhesive sheet 1 temporarily stocked in the take-up device 6 has been drawn out and thus the guides 6*b* of the take-up device 6 are restored to a state in which they are held in contact with the outer circumferential surface of the take-up roller 6*a* by the elastic member as shown in FIG. 6B.

The heat-sensitive adhesive sheet 1 of a predetermined length having thus undergone printing, cutting, and heating passes between the conveying roller 9 and the driven roller 10. After the sheet conveying direction is deflected by the conveying direction regulating means 11 so that the sheet is not inserted into the insertion opening 6*c* of the take-up device 6, the sheet is discharged outside the apparatus. Then, the sheet is directly affixed to a corrugated board, a food wrap, a glass bottle, a plastic container, etc. as an indicator label.

As discussed previously, in the thermal printer of this embodiment, the printing unit and the thermal activation unit, which are separately provided conventionally, are integrated into one unit by arranging the printing/thermal activation head 13 in the platen roller. Thus, miniaturization and lightness of the apparatus can be achieved. In particular, the platen roller 12 is used as a mechanism for reversing the heat-sensitive adhesive sheet during thermal activation on the heat-sensitive adhesive surface, which is the rear side of the heat-sensitive adhesive sheet whose printing surface on the front side has been printed. It is therefore unnecessary to additionally provide a reversing roller, thereby achieving reduction in the number of components as well as in costs for the apparatus.

Moreover, the heat-sensitive adhesive sheet 1 is inserted between the printing/thermal activation head 13 and the platen roller 12 from the same direction during both printing and thermal activation. Thus, it is possible to insert the recording sheet from the end portion side of the thermal head 13 where the heat generating portion is not arranged and thus a distance between the thermal head 13 and the platen roller 12 is wide. That is, during both printing and thermal activation, it is easy to insert the sheet between the thermal head 13 and the platen roller 12 while dispensing with a special mechanism.

In the printer of the above embodiment, the thermal head of a heat-sensitive system is used to perform, for a sheet having a printing surface on one side and a heat-sensitive adhesive surface on the other side, printing on the printing surface and thermal activation on the heat-sensitive adhesive surface. However, double-sided printing can also be performed if a sheet material having heat-sensitive printing surfaces on both sides is used.

In the case of a printer for double-sided printing, a printing head of a heat transfer system, an ink jet system, a laser print system, or the like is also applicable in place of the heat-sensitive thermal head. In such a case, plain paper is used.

While the present invention has been specifically described with reference to the two embodiments, the printer of the present invention is not limited to the above embodiments, and various modifications may be made without departing from the gist of the invention.

What is claimed is:

1. A printer, comprising:

a printing head for performing printing on one surface of a sheet;

a platen roller that is arranged opposing the printing head and allows the sheet to pass between the printing head and the platen roller;

a thermal activation head that is arranged substantially on a side opposite to the printing head with the platen roller therebetween, is opposed to the platen roller, is aligned in the same direction as the printing head on an outer circumferential surface of the platen roller, and performs thermal activation on a heat-sensitive adhesive surface that is the other surface of the sheet and develops an adhesive force upon heating;

a stocking unit that is arranged downstream of the platen roller, temporarily stocks the sheet on which printing has been performed, and delivers the temporally stocked sheet toward a position between the thermal activation head and the platen roller; and regulating means arranged between the platen roller and the stocking unit, for preventing the sheet temporarily stocked in the stocking unit from being conveyed to a position between the printing head and the platen roller when the sheet is to be conveyed to the position between the thermal activation head and the platen roller.

2. A printing method, comprising:

a printing step of performing printing on one surface of a sheet with a printing head;

a first conveyance step of causing, by a platen roller opposed to the printing head, the sheet to pass between the printing head and the platen roller in synchronization with the printing step;

a stocking step of temporarily stocking the sheet;

a thermal activation step of performing thermal activation on a heat-sensitive adhesive surface that is formed on the other surface of the sheet and develops an adhesive force upon heating with a thermal activation head; and a second conveyance step of causing, by the platen roller opposed to the printing head, the sheet to pass between the thermal activation head and the platen roller in synchronization with the thermal activation step.

* * * * *